United States Patent [19]

Seki

[11] 4,207,731

[45] Jun. 17, 1980

[54] ELECTRONIC TIMEPIECE CONTROL CIRCUIT

[75] Inventor: Hidehiko Seki, Suwa, Japan

[73] Assignee: Kabushiki Kaisha Suwa Seikosha, Tokyo, Japan

[21] Appl. No.: 852,872

[22] Filed: Nov. 18, 1977

[30] Foreign Application Priority Data

Nov. 18, 1976 [JP] Japan ..... 51-138784

[51] Int. Cl.[2] ..... G04B 19/24; G04C 3/00; G04B 27/00

[52] U.S. Cl. ..... 368/29; 368/79; 368/185

[58] Field of Search ..... 58/4 A, 23 R, 39.5, 58/58, 85.5, 74; 324/1.86; 235/92 T

[56] References Cited

U.S. PATENT DOCUMENTS

| | | | |
|---|---|---|---|
| 3,839,856 | 10/1974 | Dargent | 58/4 A |
| 3,852,950 | 12/1974 | Yoda et al. | 58/4 A |
| 3,992,871 | 11/1976 | Numabe | 58/39.5 |
| 4,058,971 | 11/1977 | Epperson | 58/50 R |

*Primary Examiner*—Edith S. Jackmon
*Attorney, Agent, or Firm*—Blum, Kaplan, Friedman, Silberman & Beran

[57] ABSTRACT

An electronic timepiece control circuit for facilitating the selection of a preferred function in a multi-functional electronic timekeeping circuit wherein each function can also be selected cyclicly in sequence, is provided. The timekeeping circuit is adapted to be disposed in at least three timekeeping functional modes to perform at least one distinct timekeeping function in each functional mode in response to a function control signal being applied thereto. Mode select circuitry is coupled to the timekeeping circuit for cyclicly selecting, in sequence, each timekeeping functional mode of the timekeeping circuit in response to each mode select signal applied thereto. A judgment circuit is coupled to thetimekeeping circuit and is adapted to return the timekeeping circuit to a predetermined timekeeping functional mode in response to a mode select signal and a function control signal being coincidentally applied thereto.

9 Claims, 2 Drawing Figures

ELECTRONIC TIMEPIECE CONTROL CIRCUIT

BACKGROUND OF THE INVENTION

This invention is directed to an electronic timepiece control circuit, and in particular to electronic timepiece control circuit for cyclically disposing in sequence a timekeeping circuit into at least three timekeeping functional modes, and that is further adapted to automatically return the timekeeping circuit to a predetermined timekeeping functional mode.

The development of highly accurate, multi-functional electronic wristwatches has been due, in large measure, to improvements in integrated circuit techniques, and improvements in electro-optical displays. Such improvements have resulted in electronic wristwatches that can not only provide a display of hour, minute, second, month, date and day of the week information, but can also function as a stopwatch or operate as a global chronometer. Although the number of functions performed by wristwatches continues to increase, efforts have been made to not increase the number of control switches utilized to select the functional modes of the electronic wristwatch and, additionally, to control the functions once the functional modes have been selected. In order to limit to three the number of switches required to select the different functions to be performed by the wristwatch and control the performance of the functions selected, mode select circuitry that sequentially selects each of the functional modes, in a cyclical manner when at least three timekeeping functions are provided, have been utilized.

For example, in a multi-functional wristwatch incorporating certain of the functions detailed above, the timekeeping circuit of the wristwatch is cyclically disposed into at least four different timekeeping functional modes including an hour-minute-second functional mode→a month-date-day of the week functional mode→a stopwatch functional mode→time correction for hours-minutes-seconds functional mode→correction for month-date-day of the week functional mode and, thereafter, a return to the hour-minute-second functional mode in response to each operation of a functional mode selection switch. Once a specific timekeeping functional mode is selected, at least one timekeeping function (such as measuring elapsed time when the timepiece is in a stopwatch mode) is performed. However, one disadvantage of cyclically disposing the timekeeping circuitry in each of the functional modes is that once the particular functional mode is selected, such as a stopwatch mode, the wristwatch cannot be returned to a preferred mode of operation, such as the hour-minutes and seconds functional mode without selecting each of the remaining functional modes in the sequence. Accordingly, for the timepiece detailed above, the mode select switch must be actuated three additional times in order to return the wristwatch to the preferred functional mode wherein hour-minute-second timekeeping information is displayed. Electronic wristwatch control circuitry that is adapted to cyclically dispose, in sequence, the timekeeping circuitry in each timekeeping functional mode and is further adapted to automatically return the timekeeping circuitry to a predetermined functional mode would overcome the disadvantage noted above.

SUMMARY OF THE INVENTION

Generally speaking, in accordance with the invention, an electronic wristwatch control circuit for use with a multi-functional timekeeping circuit, adapted to be disposed in at least three timekeeping functional modes, is provided. The timekeeping circuit is adapted to perform at least one timekeeping function in each timekeeping functional mode. The invention is particularly characterized by a control circuit for producing a functional mode select signal and a function control signal. A mode select circuit is coupled to the timekeeping circuit for cyclically selecting, in sequence, each timekeeping functional mode of the timekeeping circuit in response to each mode select signal applied thereto. The timekeeping functions performed in each functional mode are effected in response to the functional control signals being applied to the timekeeping circuitry. A judgment circuit is adapted to return the timekeeping circuit to a predetermined timekeeping functional mode in response to the mode select signal and the function control signal being coincidentally applied thereto.

Accordingly, it is an object of the instant invention to provide an improved electronic timepiece control circuit for controlling a timekeeping circuit capable of operating in at least three timekeeping functional modes.

A further object of the instant invention is to provide improved electronic wristwatch control circuitry for permitting a plurality of timekeeping functional modes to be cyclically selected, and additionally to permit a predetermined timekeeping functional mode to be automatically selected without any further control switches being provided.

Still other objects and advantages of the invention will in part be obvious and will in part be apparent from the specification.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DETAILED DESCRIPTION OF THE PREFERRED EMBODIMENT

Figure 1:
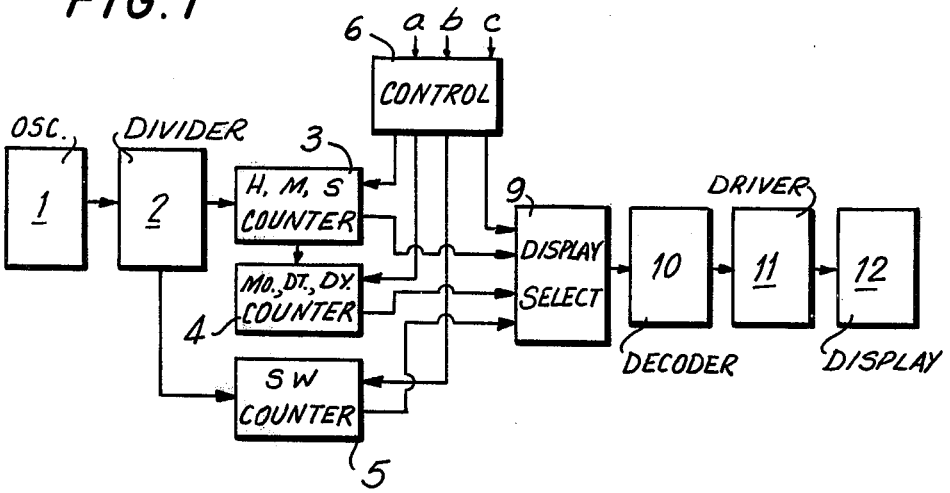
FIG. 1 is a block circuit diagram of an electronic wristwatch including a control circuit constructed in accordance with a preferred embodiment of the instant invention.

Reference is now made to FIG. 1, wherein a block circuit diagram of an electronic wristwatch, constructed in accordance with the instant invention, is depicted. An oscillator circuit having a quartz crystal vibrator as a high frequency time standard (not shown) applies a high frequency time standard signal to a divider circuit 2 comprised of a plurality of series-connected divider stages for dividing down the high frequency time standard signal and producing a low frequency time standard signal, which signal is applied to an hours, minutes and seconds counter 3. The hours, minutes and seconds counter 3 is adapted, in response to the low frequency timekeeping signal applied thereto, to produce timekeeping signals representative of hours, minutes and seconds, which signals are applied to a display select circuit 9. A month, date and day counter 4 is series-coupled to the hours, minutes and seconds counter 3 and applies timekeeping signals representative of the month, date and day to display select circuit 9. Finally, a stopwatch counter 5 is coupled to one of the divider stages of divider circuit 2 and receives an intermediate frequency signal produced thereby. The stopwatch counter is adapted to be operated as a stopwatch in a conventional manner and apply elapsed time signals to the display select circuit 9. The timekeeping and elapsed time signals applied to the display select circuit 9 are, in turn, applied through a decoder 10 and driver 11 to a digital display 12. The display select circuit 9 is adapted to selectively transmit the signals produced by one of the counters 3, 4 and 5 depending upon the functional mode selected, to thereby permit the digital display to display the particular selected function being performed.

A control circuit 6 is coupled to the counter 3, 4 and 5 and to the display circuit 9 and is adapted to cyclically and sequentially select the timekeeping functional mode of the timekeeping circuitry. Moreover, signal a, b and c represent the signals produced by the three manually operated switches (not shown) provided in the wristwatch to select the timekeeping functional mode and to perform the predetermined timekeeping functions once each functional mode is selected. Also, the control circuit 6 is adapted, in a conventional manner, to select a different timekeeping functional mode in response to each pulse a applied thereto. Similarly, when the timepiece is in a correction functional mode, the control circuit will select, in a conventional manner, the digit of time (hours, minutes, seconds or month, date day of the week) in response to each pulse b applied thereto. Alternatively, when the timekeeping circuit is operating in a stopwatch functional mode, the starting and stopping of the stopwatch mechanism is controlled in response to the application of a pulse b to the control circuit 6. Similarly, when the stopwatch counter 5 is selected, so that the timekeeping circuitry is in a stopwatch functional mode, the stopwatch is reset to a count of zero in response to pulse c and when the particular digit of time, such as hours, minutes, seconds or month, date or day, has been selected by pulse b, when the timepiece is in a correction functional mode, each application of a pulse c effects an indexing of the count of the particular digit of time being corrected.

As is detailed below, the instant invention is particularly characterized by a control circuit for use with timekeeping circuitry that has at least three timekeeping functional modes wherein at least one timekeeping function is performed in each mode. For example, in the embodiment discussed above, a first timekeeping functional mode includes the display of hours, minutes and seconds time information; a second timekeeping functional mode includes the display of the month, date and day of the weekk time information; and a third functional mode is the operation of the timepiece as a stopwatch to display elapsed time information. Still a fourth functional mode includes displaying the correction of the hours, minutes, seconds, month, date and day of the week counters in order to effect correction of the time information displayed by the wristwatch. Accordingly, the instant invention is particularly characterized by an improved control circuit 6 including a mode select circuit and judgment circuit of the type depicted in FIG. 2 of the instant application for permitting each of the timekeeping functional modes to be cyclicly and sequentially selected, and for further automatically disposing the timekeeping circuit into a predetermined timekeeping functional mode.

Figure 2:
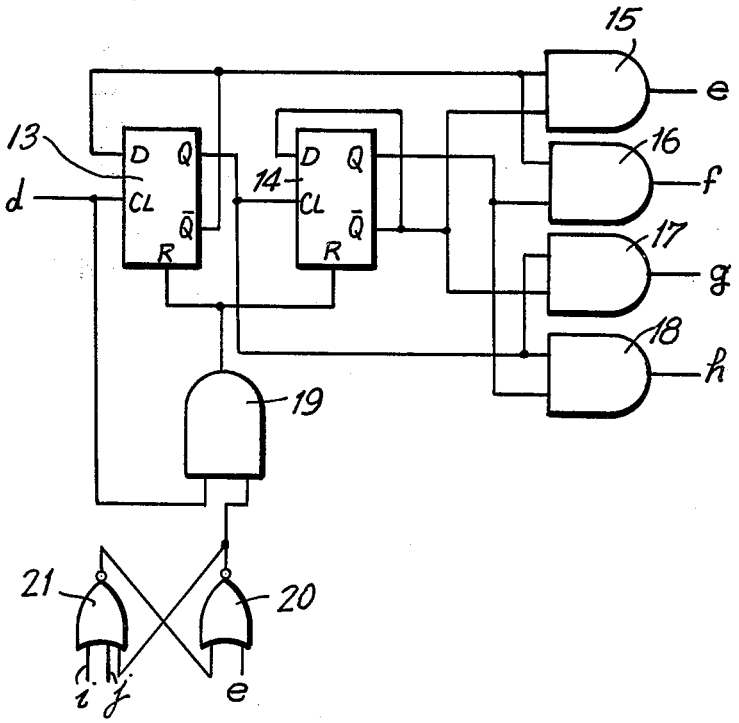
FIG. 2 is a block circuit diagram of an electronic wristwatch control circuit constructed in accordance with a preferred embodiment of the instant invention.

Reference is now made to FIG. 2, wherein the mode select circuit is comprised of a D-flip-flop 13, D-flip-flop 14 and AND gates 15 through 18. Specifically, a mode select signal d is applied to D-flip-flop 13 in response to each pulse a applied to the control circuit 6. Accordingly, the D-flip-flops 13 and 14 are indexed through four binary counts (00, 01, 10, 11) to thereby sequentially and cyclicly produce mode select output signals e, f, g and h at the outputs of AND gates 15, 16, 17 and 18, respectively. The mode selection output signal e produced at the output of AND gate 15 is utilized to select the hours, minutes and seconds counter 3 and thereby dispose the timekeeping circuitry in an hours, minutes and seconds functional mode. The output signal f is utilized to select the month, date and day counter 4 and, hence, disposes the timekeeping circuitry in a calendar function mode. The output signal g produced by AND gate 17 is applied to the stopwatch counter 5 and activates the stopwatch counter 5 to dispose the timekeeping circuitry in a stopwatch functional mode. Finally, output signal h is applied to the timekeeping circuitry in order to dispose the hours, minutes and seconds counter 3 and month, date and day counter 4 in a timekeeping correction mode, whereby correction of the specific timekeeping counter can be selected in response to the application of the function control pulses b being applied to the control circuit 6. It is noted that the mode select output signals e, f, g and h are also applied to the display select circuit 9 in order to apply the signals representative of the functional mode selected in the digital display 12 and thereby insure that the particular timekeeping function being performed by the timepiece is displayed.

In addition to the mode select circuitry detailed above, a judgment circuit comprised of AND gate 19 and a set-reset flip-flop including NOR gates 20 and 21 is provided for automatically returning the timekeeping circuitry from any of the timekeeping functional modes selected to a predetermined functional mode, which in a preferred embodiment is the hours, minutes and seconds functional mode. Specifically, signals i and j correspond to the set signal c and function select signal b and are applied to NOR gate 21 in response to each application of the pulses b and c to the control circuit 6. Accordingly, whenever the select signal e is produced at the output of AND gate 15, the hours, minutes and seconds functional mode of operation is selected, and the set-reset flip-flop comprised of NOR gates 20 and 21 is reset thereby. Thereafter, as the remaining timekeeping functional modes are selected in sequence by producing output select signals f, g and h at the outputs of NAND gates 16, 17 and 18, each of the additional timekeeping functional modes are cyclically selected, in sequence. However, if the stopwatch select signal g is being applied to the stopwatch counter 5 and display select circuit 9, in order to display the timekeeping circuit functioning as a stopwatch, and thereafter it is desired to immediately return to the hour, minute and second timekeeping functional mode, if either signals i or j is coincidentally applied to the judgement circuit at the same time as the mode select signal d is applied to the D-flip-flop 13, the signal i or j will set the flip-flop and thereby apply a HIGH level input to AND gate 19 coincident with the HIGH level input from mode select signal d, and thereby apply a HIGH level reset signal to D-flip-flops 13 and 14, to thereby reset same to zero. When the D-flip-flops 13 and 14 are reset to zero, they automatically produce functional mode select output signal e, so that the hours, minutes and seconds timekeeping functional mode is selected. Accordingly, the judgment circuit detects when the select signal produced by the mode select circuit is other than the preferred timekeeping functional mode, illustrated as the hours, minutes and second functional mode in FIG. 2, and permits the functional mode selected to return automatically to the preferred functional mode.

It is noted that any functional mode can be selected as the predetermined mode by merely feeding the predetermined mode select output signal produced at the outputs of AND gates 15 through 18 to the reset input of the set-reset flip-flop defined by NOR gates 20 and 21. Accordingly, the instant invention is particularly characterized by an electronic wristwatch control circuit that can automatically return the timekeeping circuitry to a preferred timekeeping functional mode or, alternatively, can sequentially dispose the timekeeping circuit through a cycle of timekeeping functional modes in the usual manner, without requiring any further manually operated switches to achieve such control.

It will thus be seen that the objects set forth above, among those made apparent from the preceding description, are efficiently attained and, since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. In an electronic timepiece including timekeeping circuit means having a plurality of timekeeping counters each respectively producing timekeeping signals representative of actual time, said timekeeping circuit means being adapted to be disposed in at least three timekeeping functional modes for performing at least one timekeeping function in each said mode, a first said timekeeping functional mode being a correction mode for permitting the count of at least two of said timekeeping counters to be adjusted, the adjustment of said at least two timekeeping counters being avoided when said timekeeping circuit means is disposed in other than said first functional mode, the improvement comprising control means for producing a functional mode select signal and a function control signal, said function control signal being adapted, when applied to said timekeeping circuit means, to functionally control said timekeeping circuit means without selecting another of said timekeeping functional modes, mode select coupled to said timekeeping circuit means for cyclically selecting in sequence each timekeeping functional mode of said timekeeping circuit means in response to each mode select signal being applied thereto, and judgment means, adapted to receive each said mode select signal and function control signal, for returning said timekeeping circuit means to a predetermined timekeeping functional mode in response to said mode select signal and said function control signal being coincidentally applied thereto.

2. An electronic timepiece as claimed in claim 1, wherein said mode select means is adapted to produce a distinct output select signal for each functional mode selected, said timekeeping circuit means being adapted to receive each of said distinct output select signals and in response thereto be disposed into a functional mode corresponding thereto.

3. An electronic timepiece as claimed in claim 2, wherein said mode select means includes indexing means and output gating means, said indexing means being adated to be indexed through a predetermined counting cycle in response to each mode select signal applied thereto, said output gating means being adapted in response to detecting said predetermined counting cycle to apply a distinct output select signal to said timekeeping circuit means that is representative of each count of said indexing means.

4. An electronic timepiece as claimed in claim 3, wherein said judgment means is coupled to said indexing means and is adapted to return said indexing means to a predetermined count in response to detecting the coincidental application of the mode select signal and function control signal thereto, said output gating means being adapted to produce a predetermined output select signal for selecting said predetermined timekeeping function in response to said indexing means being returned to a predetermined count.

5. An electronic timepiece as claimed in claim 4, wherein said judgment circuit means includes logic gating means for receiving said mode select signal and set-reset flip-flop means for receiving said function control signal and said predetermined output select signal, said output gating means being adapted to apply a signal to said indexing means for resetting same to a predetermined count in response to the mode select signal and set signal produced by said set-reset flip-flop means being applied thereto.

6. An electronic timepiece as claimed in claim 5, wherein said set-reset flip-flop means are set to produce a set signal when said function control signal is applied thereto, and is reset to prevent a set signal from being produced in response to said predetermined output select signal being applied thereto.

7. An electronic timepiece as claimed in claim 6, wherein said logic gating means is an AND gate, and said set-reset flip-flop means is comprised of a pair of NOR gates.

8. An electronic timepiece as claimed in claim 4, wherein said timekeeping circuit means includes hours, minutes and seconds counter means for producing timekeeping signals representative of actual time when the timekeeping circuit means is disposed in a timekeeping mode and month, date and day of the week counter means for producing calendar signals representative of calender information when said timekeeping circuit means is disposed in a calendar functional mode, said control means further including correction means for correcting said hours, minutes and seconds counter and said month, date and day of the week counter when said timepiece is in a correction functional mode, and display means adapted to also receive said output select signals and in response thereto display the timekeeping and calendar information and the correction thereof in response to the functional mode corresponding thereto having been selected.

9. An electronic timepiece as claimed in claim 8, and further including a stopwatch counter for producing elapsed time signals when said timekeeping circuit means is disposed in a stopwatch functional mode, said digital display means being adapted to display stopwatch information when said timekeeping circuit means is disposed in said stopwatch functional mode.

* * * * *